US007323280B2

(12) United States Patent
Morris et al.

(10) Patent No.: US 7,323,280 B2
(45) Date of Patent: Jan. 29, 2008

(54) CHEMICALLY PRODUCED TONER AND PROCESS THEREFOR

(75) Inventors: Daniel Patrick Morris, Manchester (GB); Martin Russell Edwards, Manchester (GB)

(73) Assignee: Fujifilm Imaging Colorants Limited, Manchester (GB)

( * ) Notice: Subject to any disclaimer, the term of this patent is extended or adjusted under 35 U.S.C. 154(b) by 477 days.

(21) Appl. No.: 10/510,437

(22) PCT Filed: Apr. 8, 2003

(86) PCT No.: PCT/GB03/01520

§ 371 (c)(1),
(2), (4) Date: Oct. 7, 2004

(87) PCT Pub. No.: WO03/087949

PCT Pub. Date: Oct. 23, 2003

(65) Prior Publication Data

US 2005/0175921 A1 Aug. 11, 2005

(30) Foreign Application Priority Data

Apr. 10, 2002 (GB) ..... 0208204.8
Sep. 11, 2002 (GB) ..... 0221090.4

(51) Int. Cl.
*G03G 9/087* (2006.01)

(52) U.S. Cl. ..... 430/108.1; 430/110.1; 430/110.3; 430/137.14; 430/109.1

(58) Field of Classification Search ..... 430/137.14, 430/110.3, 108.1, 110.1, 109.1
See application file for complete search history.

(56) References Cited

U.S. PATENT DOCUMENTS 5,219,697 A 6/1993 Mori et al. ..... 430/110
5,482,812 A 1/1996 Hopper et al.
5,486,445 A 1/1996 Van Dusen et al.
5,548,043 A 8/1996 Saban et al. ..... 526/84
5,774,771 A 6/1998 Kukimoto et al. ..... 399/223
5,955,235 A 9/1999 Lin
5,965,316 A 10/1999 Kmiecik-Lawrynowicz et al.
6,015,647 A 1/2000 Ugai et al. ..... 430/110
6,033,817 A 3/2000 Yusa et al. ..... 430/106.6
6,057,076 A * 5/2000 Berkes et al. ..... 430/111.41
6,060,202 A 5/2000 Ogawa et al. ..... 430/111
6,077,635 A 6/2000 Okado et al. ..... 430/45
6,077,636 A 6/2000 Moriki et al. ..... 430/45
6,083,654 A 7/2000 Lin ..... 430/110
6,096,468 A * 8/2000 Ohno et al. ..... 430/110.3
6,120,967 A 9/2000 Hopper et al.
6,177,223 B1 1/2001 Hashimoto et al. ..... 430/126
6,183,927 B1 2/2001 Magome et al. ..... 430/110
6,268,102 B1 7/2001 Hopper et al.
6,287,739 B1 9/2001 Kawakami et al. ..... 430/108.7
6,424,814 B2 7/2002 Otsuka et al. ..... 399/313
2003/0232266 A1* 12/2003 Sugiura et al. ..... 430/110.3
2006/0093946 A1* 5/2006 Miyamoto et al. ..... 430/110.3

FOREIGN PATENT DOCUMENTS

EP 0947887 10/1999
EP 0962832 12/1999
EP 0 992 858 A2 4/2000

* cited by examiner

*Primary Examiner*—Christopher RoDee
(74) *Attorney, Agent, or Firm*—Morgan, Lewis & Bockius LLP

(57) ABSTRACT

A toner for developing an electrostatic image comprising toner particles which include a binder resin, a wax and a colorant, wherein the wax has a melting point of between 50 and 150° C., the wax exists in the toner particles in domains of 2 μm or less mean particle size and (a) the mean circularity of the toner particles as measured by a Flow Particle Image Analyser is at least 0.90; and (b) the shape factor, SF1, of the toner particles is at most 165. A process for the manufacture of said toner which comprises the following steps: providing a latex dispersion; providing a wax dispersion; providing a colorant dispersion; mixing the latex dispersion, wax dispersion and colorant dispersion; and causing the mixture to flocculate.

32 Claims, No Drawings

CHEMICALLY PRODUCED TONER AND PROCESS THEREFOR

FIELD OF THE INVENTION

This invention relates to toners for use in the formation of electrostatic images, their process of manufacture, processes using them and to toner apparatus and components incorporating them. It further relates to any electroreprographic apparatus, component of the apparatus and consumable for use with the apparatus, which comprises such a toner, and to methods of manufacturing of such electroreprographic apparatus, components and consumables.

BACKGROUND OF THE INVENTION

Toners for development of an electrostatic image are conventionally produced by melt kneading of a pigment, resin and other toner ingredients, followed by pulverisation. Classification is then needed to generate an acceptably narrow particle size distribution.

Recently attention has been focussed on chemical routes to toners, where a suitable particle size is not attained by a milling process, which avoid the need for a classification step. By avoiding the classification step, higher yields can be attained, especially as the target particle size is reduced. Lower particle size toners are of considerable interest for a number of reasons, including better print resolution, lower pile height, greater yield from a toner cartridge, faster or lower temperature fusing, and lower paper curl.

Several routes to chemical toners have been exemplified. These include suspension polymerisation, solution-dispersion processes and aggregation routes. Aggregation processes offer several advantages including the generation of narrow particle size distributions, and the ability to make toners of different shape. The toner shape is particularly important in toner transfer from the organic photoconductor (OPC) to the substrate, and in cleaning of the OPC by a blade cleaner.

Several aggregation processes have been reported. U.S. Pat. No. 4,996,127 (Nippon Carbide) reports a process in which black toner particles are grown by heating and stirring resin particles made by emulsion polymerisation with a dispersion of carbon black, where the resin contains acidic or basic polar groups. Numerous patents from Xerox (e.g. U.S. Pat. No. 5,418,108) describe a flocculation process where particles stabilised by anionic surfactants are mixed with particles stabilised by cationic surfactants (or where a cationic surfactant is added to particles stabilised by an anionic surfactant). U.S. Pat. No. 5,066,560 and U.S. Pat. No. 4,983,488 (Hitachi Chemical Co.) describe emulsion polymerisation in the presence of a pigment, followed by coagulation with an inorganic salt, such as magnesium sulphate or aluminium chloride. The applicants' own patent applications WO 98/50828 and WO 99/50714, describe aggregation processes in which a surfactant used to stabilise the latex (i.e. the aqueous dispersion of the resin) and pigment is converted by a pH change from an ionic to a non-ionic state, so initiating flocculation.

To form a permanent image on the substrate, it is necessary to fuse or fix the toner particles to the substrate. This is commonly achieved by passing the unfused image between two rollers, with at least one of the rollers heated. It is important that the toner does not adhere to the fuser rollers during the fixation process. Common failure modes include paper wrapping (where the paper follows the path of the roller) and offset (where the toner image is transferred to the fuser roller, and then back to a different part of the paper, or to another paper sheet). One solution to these problems is to apply a release fluid, e.g. a silicone oil, to the fuser rollers. However this has many disadvantages, in that the oil remains on the page after fusing, problems can be encountered in duplex (double-sided) printing, and the operator must periodically re-fill the oil dispenser. These problems have led to a demand for so-called "oil-less" fusion, in which a wax incorporated in the toner melts during contact of the toner with the heated fuser rollers. The molten wax acts as a release agent, and removes the need for application of the silicone oil.

There are many problems associated with the inclusion of wax in a toner. Wax present at the surface of the toner may affect the triboelectric charging and flow properties, and may reduce the storage stability of the toner by leading to toner blocking. Another problem frequently encountered is filming of the wax onto the metering blade and development rollers (for mono-component printers) or the carrier bead (for dual-component printers or copiers), and onto the photoconductor drum. Where contact charging and/or contact development are employed, and where cleaning blades or rollers are used, these can place an extra stress on the toner and make it more prone to filming. If the wax is not well dispersed in the toner problems with transparency in colour toners can be found, and high haze values result. With conventional toners, prepared by the extrusion/pulverisation route, it has only proved possible to introduce relatively small amounts of wax without encountering the above problems.

With colour toners, the demands on the toner to achieve oil-less release are much more severe than with monochrome printing. As typically four colours are used in full-colour printing, the mass of toner which can be deposited per unit area is much higher than with black printing. Print densities of up to around 2 mg/cm$^2$ may be encountered in colour printing, compared with about 0.4-0.7 mg/cm$^2$ in monochrome prints. As the layer thickness increases it becomes more difficult to melt the wax and obtain satisfactory release at acceptable fusion temperatures and speeds. Of course it is highly desirable to minimise the fusion temperature, as this results in lower energy consumption and a longer fuser lifetime. With colour printing it is also important that prints show high transparency. In addition it is necessary to be able to control the gloss level. Inclusion of waxes in colour toners can have detrimental effects on transparency, and can make it difficult to reach higher gloss levels.

The efficiency of wax melting can be increased by reducing the wax melting point. However this often leads to increased storage stability problems, and in more pronounced filming of the OPC or metering blade. The domain size of the wax is also important, as this affects the release, storage stability and transparency of the toner.

The release properties of the toner can also be affected by the molecular weight distribution of the toner, i.e. the resin thereof. Broader molecular weight distribution toners, which include a proportion of higher molecular weight (or alternatively cross-linked resin), generally show greater resistance to offset at higher fusion temperatures. However, when large amounts of high molecular weight resins are included, the melt viscosity of the toner increases, which requires a higher fusion temperature to achieve fixation to the substrate and transparency. The haze values of the prints will then vary considerably with fusion temperature, with unacceptably high values at low fusion temperatures. Haze may be assessed using a spectrophotometer, for example a Minolta CM-3600d, following ASTM D 1003.

Therefore the requirements for achieving an oil-less fusion colour system are severe. It is necessary to achieve a reasonably low fusion temperature, with an acceptably wide release temperature window, including with high print densities. The prints must show good transparency with controllable gloss. The toner must not show blocking under normal storage conditions, and must not lead to filming of the OPC or metering blade.

In addition it is important that the quality of the prints is maintained over a long print run, and that the toner is efficiently used. To achieve these goals there must be little development of the non-image areas of the photoconductor (OPC) and the toner must show a high transfer efficiency from the photoconductor to the substrate (or to an intermediate transfer belt or roller). If the transfer efficiency is close to 100% it is possible to avoid the need for a cleaning step, where residual toner is removed from the photoconductor after transfer of the image. However many electrophotographic devices contain a mechanical cleaning device (such as a blade or a roller) to remove any residual toner from the photoconductor. Such residual toner may arise either from development of the non-image areas of the photoconductor, or from incomplete transfer from the photoconductor to the substrate or intermediate transfer belt or roller. A high transfer efficiency is especially important for colour devices, where sometimes more than one transfer step is required (for example from the photoconductor to a transfer belt or roller, and subsequently from the transfer belt or roller to the substrate).

It is known in the art that the shape of the toner can have a pronounced effect on its transfer and cleaning properties. Toners prepared by conventional milling techniques tend to have only moderate transfer efficiencies due to their irregular shape. Spherical toners may be prepared by chemical routes, such as by suspension polymerisation or by latex aggregation methods. These toners can transfer well, but the efficiency of cleaning with mechanical cleaning devices such as cleaning blades is low.

It is therefore desirable to produce a toner which can satisfy many requirements simultaneously. The toner should be capable of fixing to the substrate at low temperatures by means of heated fusion rollers where no release oil is applied. The toner should be capable of releasing from the fusion rollers over a wide range of fusion temperatures and speeds, and over a wide range of toner print densities. To achieve this it is necessary to include a wax or other internal release agent in the toner. This release agent must not cause detrimental effects on storage stability, print transparency or toner charging characteristics, and must not lead to background development of the photoconductor (OPC). It must also not lead to filming of the metering blade or development roller (for a mono-component device) or the carrier bead (for a dual-component device), or of the photoconductor. In addition the shape of the toner must be controlled so as to give high transfer efficiency from the photoconductor to the substrate or intermediate transfer belt or roller, and from the transfer belt or roller (where used) to the substrate. If a mechanical cleaning device is used the shape of the toner must also be such as to ensure efficient cleaning of any residual toner remaining after image transfer.

Several patents exemplify aggregation processes where a single latex, made by a one-stage emulsion polymerisation process, is aggregated with a wax dispersion. Examples where a system based on counterionic surfactants (i.e. an anionic and a cationic surfactant) is used include U.S. Pat. No. 5,994,020 and U.S. Pat. No. 5,482,812 (both to Xerox). Examples where an inorganic coagulant is used include U.S. Pat. No. 5,994,020, U.S. Pat. No. 6,120,967, U.S. Pat. No. 6,268,103 and U.S. Pat. No. 6,268,102 (all to Xerox). Mixed inorganic and organic coagulants are used in U.S. Pat. No. 6,190,820 and U.S. Pat. No. 6,210,853 (both to Xerox). U.S. Pat. No. 4,996,127 (Nippon Carbide) exemplifies a process in which a latex containing an acidic-functional group is heated and stirred with a wax dispersion and carbon black to grow aggregate toner particles.

U.S. Pat. No. 5,928,830 (Xerox) discloses a two stage emulsion polymerisation to make a core shell latex. The shell is made generally of higher molecular weight and/or Tg than the core. The latex is then mixed with pigment and flocculated through use of counterionic surfactants. Inclusion of wax is not exemplified.

U.S. Pat. No. 5,496,676 (Xerox) discloses use of blends of different latexes with different molecular weight to increase the fusion latitude. Each latex is made by a single stage polymerisation. Toners were made by flocculating the mixed latexes with a pigment dispersion containing a counterionic surfactant. Inclusion of wax is not exemplified.

In U.S. Pat. No. 5,965,316 (Xerox) encapsulated waxes are made by carrying out the emulsion polymerisation in the presence of a wax dispersion. These emulsion polymers containing wax are mixed with non wax containing latexes of similar molecular weight, and toners made using a counterionic flocculation route.

JP 2000-35690 and JP 2000-98654 describe aggregation processes where a non-ionically stabilised dispersion of an ester-type wax is aggregated with mixed polymer emulsions of different molecular weight.

U.S. Pat. No. 5,910,389, U.S. Pat. No. 6,096,465 and U.S. Pat. No. 6,214,510 (Fuji Xerox) disclose blends of resins with different molecular weights, incorporating hydrocarbon waxes of melting point ~85° C. U.S. Pat. No. 6,251,556 (Fuji Xerox) also discloses blends of resins, as well as a two stage emulsion polymerisation to make a core shell latex. The only wax which is incorporated is a high melting point (160° C.) polypropylene wax.

Control over the toner particle shape in aggregation processes has been demonstrated. U.S. Pat. No. 5,501,935 and U.S. Pat. No. 6,268,102 (Xerox) both exemplify spherical particles. Toners which are non-spherical, but have low shape factors are disclosed in U.S. Pat. No. 6,268,103 (Xerox); U.S. Pat. No. 6,340,549, U.S. Pat. No. 6,333,131, U.S. Pat. No. 6,096,465, U.S. Pat. No. 6,214,510 and U.S. Pat. No. 6,042,979 (Fuji Xerox); and U.S. Pat. No. 5,830,617 and U.S. Pat. No. 6,296,980 (Konica). Advantages of lower shape factors in improving transfer efficiency are shown in U.S. Pat. No. 6,214,510 and U.S. Pat. No. 6,042,979 (Fuji Xerox) and U.S. Pat. No. 5,830,617 (Konica). Other references which disclose shape factors of toners are U.S. Pat. No. 5,948,582, U.S. Pat. No. 5,698,354, U.S. Pat. No. 5,729,805, U.S. Pat. No. 5,895,151, U.S. Pat. No. 6,308,038, U.S. 5,915,150 and U.S. Pat. No. 5,753,396. However, none of these references discloses a toner for use in a mono-component electroreprographic apparatus which is capable of demonstrating: release from oil-less fusion rollers over a wide range of fusion temperature and print density; high transparency for OHP slides over a wide range of fusion temperature and print density; high transfer efficiency and the ability to clean any residual toner from the photoconductor, and the absence of filming of the metering blade, development roller and photoconductor over a long print run.

SUMMARY OF THE INVENTION

Therefore, obtaining a suitable toner, and a process for making it, which meets all the above requirements is difficult and requires careful selection of the many possible components and parameters, each of which has constraints imposed on its physical and chemical properties by the final parameters of the system.

According to the present invention there is provided a toner for developing an electrostatic image comprising toner particles which include a binder resin, a wax and a colorant, wherein the wax has a melting point of between 50 and 150° C., the wax exists in the toner particles in domains of 2 μm or less mean particle size and (a) the mean circularity of the toner particles as measured by a Flow Particle Image Analyser is at least 0.90; and (b) the shape factor, SF1, of the toner particles is at most 165.

The mean circularity of the toner particles as measured by a Flow Particle Image Analyser is preferably at least 0.93, more preferably at least 0.94. The mean circularity of the toner particles is preferably less than 0.99. A particularly preferred range is 0.94-0.96.

The shape factor, SF1 (as hereinafter defined), of the toner particles is preferably at most 155, more preferably at most 150, still more preferably at most 145. SF1 is preferably at least 105. A particularly preferred range of SF1 is from 130 to 150 and most particularly preferred is from 135 to 145.

The shape factor, SF2 (as hereinafter defined), of the toner particles is preferably at most 155, more preferably at most 145, even more preferably at most 140, still even more preferably at most 135. SF2 is preferably at least 105. A particularly preferred range of SF2 is from 120-140, and most particularly preferred is 125-135.

The smoothness of the toner after the coalescence stage may be assessed by measuring the surface area of the toner, for example by the BET method. It is preferred that the BET surface area of the unformulated toner is in the range 0.5-2.0 $m^2/g$, preferably 0.6-1.3 $m^2/g$, more preferably 0.7-1.1 $m^2/g$, still more preferably 0.9-1.0 $m^2/g$ By unformulated is meant the toner prior to any optional blending with surface additives.

The average size of the toner particles is preferably in the range from 4-10 μm.

Toner having the above shape properties has been found to have high transfer efficiency from the photoconductor to a substrate (or to an intermediate transfer belt or roller), in some cases close to 100% transfer efficiency.

We have found that it is possible to incorporate wax in relatively high amounts (e.g. about 5-15 wt %) without problems of blocking or filming, and without adverse effects on toner flow or tribocharge, or on print transparency. The wax is present in the toner in domains of mean diameter 2 μm or less, preferably 1.5 μm or less. Preferably, the wax domains are of mean diameter 0.5 μm or greater. Preferably the wax is not substantially present at the surface of the toner. The relatively high wax levels allow oil-less release even at high print densities, without requiring excessive amounts of high weight average molecular weight ($M_w$) resin. This allows fixation at low temperatures, and high transparency across a range of fusion temperatures.

The resin may have a ratio of weight average molecular weight (Mw) to number average molecular weight (Mn) of at least 3, preferably at least 5, more preferably at least 10.

Preferably, to achieve satisfactory oil-less release at high temperatures, the polymer chains present in the binder resin encompass a wide range of molecular weights. This can be achieved either by mixing resin particles of widely different molecular weight, or by synthesising a latex (i.e. an aqueous dispersion of resin) for preparing the binder resin, e.g. by an aggregation process, containing a broad molecular weight distribution. A combination of both approaches can be used.

Latexes for preparing the binder resin may be made by polymerisation processes known in the art, preferably by emulsion polymerisation. The molecular weight can be controlled by use of a chain transfer agent (e.g. a mercaptan), by control of initiator concentration or by heating time. Preferably, the binder resin is prepared from at least one latex containing a resin having a monomodal molecular weight distribution and at least one latex containing a resin having a bimodal molecular weight distribution. By a resin with a monomodal molecular weight distribution is meant one in which the gpc spectrum shows only one peak. By a resin with a bimodal molecular weight distribution is meant one where the gpc chromatogram shows two peaks, or a peak and a shoulder. Latexes with a bimodal molecular weight distribution may be made using a two-stage polymerisation. Preferably a higher molecular weight resin is made first, then in a second stage, a lower molecular weight resin is made in the presence of the first resin. As a result, a bimodal molecular weight distribution resin is made containing both low and high molecular weight resins. This may then be mixed with a monomodal low molecular weight resin. In a further aspect of the invention, three latexes can be used, where preferably at least two of these are of resins which show bimodal molecular weight distributions. In a further preference, the second bimodal resin in the latexes is of higher molecular weight than the first.

Preferably, the monomodal molecular weight resin contained in the latex is a low molecular weight resin and has a number average molecular weight of from 3000 to 10000, more preferably from 3000 to 6000. Where the binder resin is prepared from one bimodal resin contained in a latex (in addition to the monomodal resin in a latex), the bimodal resin preferably has a weight average molecular weight of from 100,000 to 500,000, more preferably from 200,000 to 400,000. Where the binder resin is prepared from more than one bimodal resin contained in a latex (in addition to the monomodal resin in a latex), one bimodal resin may optionally have a weight average molecular weight from 500,000 to 1,000,000 or more (e.g. in addition to the bimodal resin having a weight average molecular weight of from 100,000 to 500,000).

The higher molecular weight resins may also contain cross-linked material by inclusion of a multifunctional monomer (e.g. divinylbenzene or a multi-functional acrylate)

It is preferred that the overall molecular weight distribution of the toner resin shows Mw/Mn of 3 or more, more preferably 5 or more, most preferably 10 or more. The Tg of each resin is preferably from 30 to 100° C., more preferably from 45 to 75° C., most preferably from 50 to 70° C. If the Tg is too low, the storage stability of the toner will be reduced. If the Tg is too high, the melt viscosity of the resin will be raised, which will increase the fixation temperature and the temperature required to achieve adequate transparency. It is preferred that all the components in the resin have a substantially similar Tg.

The resin may include one or more of the following preferred monomers for emulsion polymerisation: styrene and substituted styrenes; acrylate and methacrylate alkyl esters (e.g. butyl acrylate, butyl methacrylate, methyl acrylate, methyl methacrylate, ethyl acrylate or methacrylate, octyl acrylate or methacrylate, dodecyl acrylate or methacrylate etc.); acrylate or methacrylate esters with polar functionality, for example hydroxy or carboxylic acid functionality, hydroxy functionality being preferred (particularly 2-hydroxyethyl acrylate, 2-hydroxyethyl methacrylate, or hydroxy-terminated poly(ethylene oxide) acrylates or methacrylates, or hydroxy-terminated poly(propylene oxide) acrylates or methacrylates), examples of monomers with carboxylic acid functionality including acrylic acid and beta-carboxyethylacrylate; vinyl type monomers such as ethylene, propylene, butylene, isoprene and butadiene; vinyl esters such as vinyl acetate; other monomers such as acrylonitrile, maleic anhydride, vinyl ethers. The binder resin may comprise a co-polymer of two or more of the above monomers.

Preferred resins are copolymers of (i) a styrene or substituted styrene, (ii) at least one alkyl acrylate or methacrylate and (iii) an hydroxy-functional acrylate or methacrylate.

The resin may be prepared from the following, not used in emulsion polymerisation: dispersions of polyesters, polyurethanes, hydrocarbon polymers, silicone polymers, polyamides, epoxy resins etc.

Preferably, the latex as above described is a dispersion in water. Optionally for a preferred process, the latex dispersion further comprises an ionic surfactant; preferably the surfactant present on the dispersions contains a group which can be converted from an ionic to a non-ionic form by adjustment of pH. Preferred groups include carboxylic acids or tertiary amines. Preferably, the ionic surfactant has a charge of the same sign (anionic or cationic) as that of the surfactant used in the wax and colorant dispersions described below. Optionally a non-ionic surfactant may also be incorporated into the latex dispersion.

The wax should have a melting point (mpt) (as measured by the peak position by differential scanning calorimetry (dsc)) of from 50 to 150° C., preferably from 50 to 130° C., more preferably from 50 to 110° C., especially from 65 to 85° C. If the mpt is >150° C. the release properties at lower temperatures are inferior, especially where high print densities are used. If the mpt is <50° C. the storage stability of the toner will suffer, and the toner may be more prone to showing filming of the OPC or metering blade.

In a further embodiment of the invention, for preparing the toner, the wax is made as a dispersion in water, preferably stabilised with an ionic surfactant. The ionic surfactant is selected from the same classes as described above for the latex dispersion; preferably, the ionic surfactant has the same sign (anionic or cationic) as the surfactant used for the latex dispersion described above and the colorant dispersion described below. The mean volume particle size of the wax in the dispersion is preferably in the range from 100 nm to 2 μm, more preferably from 200 to 800 nm, most preferably from 300 to 600 nm, and especially from 350 to 450 nm. The wax particle size is chosen such that an even and consistent incorporation into the toner is achieved.

The wax should be present in the toner in domains, where the mean size of the domains is at most 2 μm, preferably 1.5 μm or less. If the mean size of the wax domains is >2 μm, the transparency of the printed film may be reduced, and the storage stability may decrease. The particle size values given are those measured by a Coulter LS230 Particle Size Analyser (laser diffraction) and are the volume mean.

The wax may comprise any conventionally used wax. Examples include hydrocarbon waxes (e.g. polyethylenes such as Polywax™ 400, 500, 600, 655, 725, 850, 1000, 2000 and 3000 from Baker Petrolite; paraffin waxes and waxes made from CO and $H_2$, especially Fischer-Tropsch waxes such as Paraflint™ C80 and H1 from Sasol; ester waxes, including natural waxes such as Carnauba and Montan waxes; amide waxes; and mixtures of these. Hydrocarbon waxes are preferred, especially Fischer-Tropsch and paraffin waxes. It is especially preferred to use a mixture of Fischer-Tropsch and Carnauba waxes, or a mixture of paraffin and Carnauba waxes.

The amount of wax incorporated in the toner is preferably from 1 to 30 wt % based on the total weight of the base toner composition (i.e. the toner particles prior to any blending with a surface additive), more preferably from 3 to 20 wt %, especially from 5 to 15 wt %. If the level of wax is too low, the release properties will be inadequate for oil-less fusion. Too high a level of wax will reduce storage stability and lead to filming problems. The distribution of the wax through the toner is also an important factor, it being preferred that wax is substantially not present at the surface of the toner.

Advantageously, the toner is capable of fixing to the substrate at low temperatures by means of heated fusion rollers where no release oil is applied and is capable of releasing from the fusion rollers over a wide range of fusion temperatures and speeds, and over a wide range of toner print densities. Furthermore, it has been found that the toner according to the invention does not lead to background development of the photoconductor (OPC) and does not lead to filming of the metering blade or development roller (for a mono-component device) or the carrier bead (for a dual-component device), or of the photoconductor.

Advantageously, the haze values of prints using the toner of the invention do not vary considerably with fusion temperature. Haze may be assessed using a spectrophotometer, for example a Minolta CM-3600d, following ASTM D 1003. Preferably, the haze at a print density of 1.0 mg/cm$^2$ is below 40, preferably below 30, and the ratio of the values at fusion temperatures of 130 and 160° C. is preferably at most 1.5, more preferably at most 1.3 and most preferably at most 1.2.

Accordingly, the invention in another aspect provides a process for forming an image, the process comprising developing an electrostatic image using a toner according to the invention, wherein the haze at a print density of 1.0 mg/cm$^2$ is below 40, and the ratio of the values at fusion temperatures of 130 and 160° C. is at most 1.5, preferably at most 1.3 and more preferably at most 1.2. The fusion speed in the process may be at least 10 A4 size pages per minute, preferably at least 20 A4 pages per minute.

The colorant is preferably present in an amount from 1-15 wt % of the total base toner composition (i.e. the toner particles prior to any blending with a surface additive), more preferably 1.5-10 wt %, most preferably 2-8 wt %. These ranges are most applicable for organic, non-magnetic pigments. If, e.g., magnetite was used as a magnetic filler/pigment, the level would typically be higher. Preferably the colorant comprises a pigment or blend of pigments. Any suitable pigment can be used, including black and magnetic pigments. For example carbon black, magnetite, copper phthalocyanine, quinacridones, xanthenes, mono- and disazo pigments, naphthols etc. Examples include Pigment Blue 15:3, Red 31, 57, 81, 122, 146, 147 or 184; Yellow 12, 13, 17, 74, 180 or 185. Preferably, in an embodiment for preparing the toner, the colorant is milled with an ionic surfactant, and optionally a non-ionic surfactant until the particle size is reduced, preferably to <300 nm, more preferably <100 nm. In full colour printing it is normal to use yellow, magenta, cyan and black toners. However it is possible to make specific toners for spot colour or custom colour applications. When the colorant is milled with an ionic surfactant, the surfactant is preferably selected from the same classes of surfactant described above for the latex (binder resin) and the wax; more preferably the surfactant has the same sign as both the surfactants used above. The colorant dispersion is also preferably a dispersion in water.

The toner as described above may additionally optionally comprise a charge control agent (CCA); preferably the charge control agent has been milled with the colorant. Suitable charge control agents are preferably colourless, however coloured charge control agents may be used. Preferably, they include metal complexes, more preferably aluminium or zinc complexes, phenolic resins etc. Examples include Bontron™ E84, E88, E89 and F21 from Orient; Kayacharge N1, N3 and N4 from Nippon Kayaku; LR147 from Japan Carlit; TN-105 from Hodogaya. These can be milled in a similar manner to the pigment. Where the CCA is added externally, a suitable high-speed blender may be used, e.g. a Nara Hybridiser. Alternatively, the CCA may be added as part of the pre-flocculation mixture, preferably as a wet cake.

The toner may have one more surface additives, as described below, e.g. to improve powder flow properties of the toner.

Preferably, the toner is made by a process which comprises flocculating a dispersion of the resin (i.e. a latex), a dispersion of the wax and a dispersion of the colorant, followed by heating and stirring to form composite particles containing the resin, wax and colorant, and then coalescing these particles above the Tg of the resin to form the toner particles. Preferably the coalescence stage is controlled, such that the features of the toner such as the wax domain size and the toner particle shape are achieved.

We have found that by using an aggregation process with particular wax dispersions, it is possible to incorporate wax in relatively high amounts as aforementioned.

According to the present invention, there is also provided a process for the manufacture of a toner according to the above which comprises the following steps:

i. providing a latex dispersion (i.e. containing resin particles);
ii. providing a wax dispersion;
iii. providing a colorant dispersion;
iv. mixing the latex dispersion, wax dispersion and colorant dispersion; and
v. causing the mixture to flocculate.

All of the features of the toner of the invention, particularly in regard to the resin or latex, wax, colorant and optional charge control agent are also applicable to the process.

The process may further comprise, prior to step iv, the additional step of providing a charge control agent component, which component may then be incorporated in step iv by mixing. The charge control agent may be milled with the colorant.

Preferably, each dispersion is a dispersion in water.

The latex dispersion preferably comprises an ionic surfactant. More preferably the preparation of the latex dispersion comprises mixing together at least one latex with monomodal molecular weight distribution and at least one latex with bimodal molecular weight distribution. The preparation of the latex with bimodal molecular weight distribution preferably comprises the successive steps of formation of a resin of high molecular weight distribution followed by formation of a resin of low molecular weight distribution such that the resulting latex comprises composite particles comprising both the said low molecular weight resin and the said high molecular weight resin. The preparation of the wax dispersion in such a process preferably comprises the mixing together of the wax with an ionic surfactant. The preparation of the colorant dispersion in such a process preferably comprises the milling together of the colorant with an ionic surfactant.

It is preferred that the dispersions of latex, colorant, charge control agent where present, and wax have the same sign charge on the surfactant. This enables individual components to be well mixed prior to flocculation. It is further preferred to use the same surfactant for each of the individual dispersions. The mixed dispersions are then flocculated in step (v). Any suitable method could be used, e.g. addition of an inorganic salt, an organic coagulant, or by heating and stirring. In a preferred method, the surfactant present on the dispersions contains a group which can be converted from an ionic to a non-ionic form and vice versa by adjustment of pH. In a preferred example, the surfactant may contain a carboxylic acid group, and the dispersions may be mixed at neutral to high pH. Flocculation may then be effected by addition of an acid, which converts the surfactant from anionic to non-ionic. Alternatively the surfactant can be the acid salt of a tertiary amine, used at low pH. Flocculation may then be effected by addition of a base which converts the surfactant from cationic to non-ionic form. The flocculation step is preferably carried out below the Tg of the resin, but the mixed dispersions may be heated prior to flocculation. Such processes as described above, allow a very efficient use of surfactant, and the ability to keep overall surfactant levels very low. This is advantageous since residual surfactant can be problematic, especially in affecting the charging properties of the toner, particularly at high humidity. In addition, such processes avoid the need for large quantities of salt, as required for many prior art processes, which would need to be washed out.

After the flocculation step (v), the process as described above may optionally comprise heating, and optionally stirring, the flocculated mixture to form loose aggregates, i.e. composite particles, of particle size from 3 to 20 μm. Once the correct particle size is established, the aggregates may be stabilised against further growth. This may be achieved, for example, by addition of further surfactant, and/or by a change in pH. The temperature may then be raised above the $T_g$ of the resin to bring about coalescence of the particles within each aggregate to form coalesced toner particles. During this step the shape of the toner may be controlled through selection of the temperature and the heating time.

The shape of the toner may be measured by use of a Flow Particle Image Analyser (Sysmex FPIA) and by image analysis of images generated by scanning electron microscopy (SEM).

The circularity is defined as the ratio:

Lo/L where Lo is the circumference of a circle of equivalent area to the particle, and L is the perimeter of the particle itself.

The shape factor, SF1, is defined as:

$SF1=(ML)^2/A\times\pi/4\times100$, where ML=maximum length across toner, A=projected area The shape factor, SF2, is defined as:

$SF2=P^2/A\times\frac{1}{4}\pi\times100$, where P=the perimeter of the toner particle, A=projected area An average of approximately 100 particles is taken to define the shape factors for the toner.

SF1 is a measure of the deviation from a spherical shape (SF1 of 100 being spherical). SF2 is a measure of the surface smoothness.

If the toner is designed for a printer or copier which does not employ a mechanical cleaning device, it may be preferred to coalesce the toner until a substantially spherical shape is attained. If, however, the toner is designed for use in a printer or copier in which a mechanical cleaning device is employed to remove residual toner from the photoconductor after image transfer, it may be preferred to select a smooth off-spherical shape, where the mean circularity is in the range 0.90-0.99, preferably 0.93-0.99, more preferably 0.94-0.99, still more preferably 0.94-0.96, where SF1 is 105-165, preferably 105-155, more preferably 105-150, still more preferably 105-145 and where SF2 is 105-155, preferably 105-145, more preferably 105-140, still more preferably 105-135. The SF1 is particularly preferably 130-150 and most particularly preferred of all 135-145. SF2 is particularly preferably 120-140, and most particularly preferred of all 125-135. Preferably, SF1>SF2. The ratio SF1/SF2 is preferably from 1.05 to 1.15, more preferably from 1.07 to 1.13, still more preferably from 1.08 to 1.12.

The smoothness of the toner after the coalescence stage may also be assessed by measuring the surface area of the toner, for example by the BET method. It is preferred that the BET surface area of the unformulated toner is in the range 0.5-2.0 $m^2/g$, preferably 0.6-1.3 $m^2/g$, more preferably 0.7-1.1 $m^2/g$, still more preferably 0.9-1.0 $m^2/g$. By unformulated is meant the toner prior to any optional blending with surface additives.

Advantageously, the manner of making the toner according to the process of invention enables the shape of the toner to be controlled so as to give both high transfer efficiency from the photoconductor to the substrate or intermediate transfer belt or roller, and from the transfer belt or roller (where used) to the substrate, as well as to ensure efficient cleaning of any residual toner remaining after image transfer.

The cooled dispersion of coalesced toner particles is then optionally washed to remove surfactant, and then optionally dried.

The toner particles may then be blended with one or more surface additives to improve the powder flow properties of the toner, or to tune the tribocharge properties. Typical surface additives include, but are not limited to, silica, metal oxides such as titania and alumina, polymeric beads (for example acrylic or fluoropolymer beads) and metal stearates (for example zinc stearate). Conducting additive particles may also be used, including those based on tin oxide (e.g. those containing antimony tin oxide or indium tin oxide). The additive particles, including silica, titania and alumina, may be made hydrophobic, e.g. by reaction with a silane and/or a silicone polymer. Examples of hydrophobising groups include alkyl halosilanes, aryl halosilanes, alkyl alkoxysilanes (e.g. butyl trimethoxysilane, iso-butyl trimethoxysilane and octyl trimethoxysilane), aryl alkoxysilanes, hexamethyldisilazane, dimethylpolysiloxane and octamethylcyclotetrasiloxane. Other hydrophobising groups include those containing amine or ammonium groups. Mixtures of hydrophobising groups can be used (for example mixtures of silicone and silane groups, or alkylsilanes and aminoalkylsilanes.)

Examples of hydrophobic silicas include those commercially available from Nippon Aerosil, Degussa, Wacker-Chemie and Cabot Corporation. Specific examples include those made by reaction with dimethyldichlorosilane (e.g. Aerosil™ R972, R974 and R976 from Degussa); those made by reaction with dimethylpolysiloxane (e.g. Aerosil™ RY50, NY50, RY200, RY200S and R202 from Degussa); those made by reaction with hexamethyldisilazane (e.g. Aerosil™ RX50, NAX50, RX200, RX300, R812 and R812S from Degussa); those made by reaction with alkylsilanes (e.g. Aerosil™ R805 and R816 from Degussa) and those made by reaction with octamethylcyclotetrasiloxane (e.g. Aerosil™ R104 and R106 from Degussa).

The primary particle size of the silicas used is typically from 5 to 100 nm, preferably from 7 to 50 nm. The BET surface area of the silicas may be from 20 to 350 $m^2/g$, preferably 30-300 $m^2/g$. Combinations of silicas with different particle size and/or surface area may be used. Preferred examples of combinations of silicas with different primary particle size are: Aerosil™ R972 or R812S (Degussa), or HDK™ H15 or H30 (Wacker); with Aerosil™ RX50, RY50 (Degussa) or HDK™ H05TD, H05TM or H05TX (Wacker). Each additive may be used at 0.1-5.0 wt % based on toner, preferably 0.2-3.0 wt %, more preferably 0.25-2.0 wt %. It is possible to blend the different size additives in a single blending step, but it is often preferred to blend them in separate blending steps. In this case, the larger additive may be blended before or after the smaller additive. It may further be preferred to use two stages of blending, where in at least one stage a mixture of additives of different particle size is used. For example, an additive with low particle size may be used in the first stage, with a mixture of additives of different particle size in the second step. Examples would include use of Aerosil™ R812S or R972, or HDK™ H15 or H30 in the first step, along with a mixture containing one of these additives with a larger additive (such as Aerosil™ RX50 or RY50, or HDK™ H05TD, H05TM or H05TX) in the second step. In such a case it would be preferred to use 0.2-3.0 wt %, preferably 0.25-2.0 wt % of the smaller additive in the first step, and 0.1 to 3.0 wt %, preferably 0.2 to 2.0 wt % of each of the additives in the second step.

Where titania is used, it is preferred to use a grade which has been hydrophobised, e.g. by reaction with an alkylsilane and/or a silicone polymer. The titania may be crystalline or amorphous. Where crystalline it may consist of rutile or anatase structures, or mixtures of the two. Examples include grades T805 or NKT90 from Nippon Aerosil.

Hydrophilic or hydrophobic grades of alumina may be used. A preferred grade is Aluminium Oxide C from Degussa.

It is often preferred to use combinations of silica and titania (e.g. R972, H15, R812S or H30 with NKT90), or of silica, titania and alumina (e.g. R972, H15, R812S or H30 with NKT90 and Aluminium Oxide C). Combinations of large and small silicas, as described above, can be used in conjunction with titania, alumina, or with blends of titania and alumina.

Preferred formulations of surface additives include those in the following list: hydrophobised silica;

large and small particle size silica combinations, which silicas may be optionally hydrophobised;

hydrophobised silica and one or both of hydrophobised titania and hydrophilic or hydrophobised alumina;

large and small particle size silica combinations as described above and one or both of hydrophobised titania and hydrophilic or hydrophobised alumina.

Polymer beads or zinc stearate may be used to improve the transfer efficiency or cleaning efficiency of the toners. Charge control agents may be added in the external formulation (i.e. surface additive formulation) to modify the charge level or charging rate of the toners.

The total level of surface additives used may be from about 0.1 to about 10 wt %, preferably from about 0.5 to 5%, based on the weight of the base toner, i.e. prior to addition of the surface additive. The additives may be added by blending with the toner, using, for example, a Henschel blender, a Nara Hybridiser, or a Cyclomix blender (Hosokawa).

The toner may be used as a mono-component or a dual component developer. In the latter case the toner is mixed with a suitable carrier bead.

The invention is particularly suitable for use in an electroreprographic apparatus or method where one or more of the following hardware conditions of an electroreprographic device applies:

i) where the device contains a developer roller and metering blade (i.e. where the toner is a monocomponent toner);

ii) where the device contains a cleaning device for mechanically removing waste toner from the photoconductor;

iii) where the photoconductor is charged by a contact charging means;

iv) where contact development takes place or a contact development member is present;

v) where oil-less fusion rollers are used;

vi) where the above devices are four colour printers or copiers, including tandem machines Advantageously, the invention provides a toner which satisfies many requirements simultaneously. The toner is particularly advantageous for use in a mono-component electroreprographic apparatus and is capable of demonstrating: release from oil-less fusion rollers over a wide range of fusion temperature and print density; high transparency for OHP slides over a wide range of fusion temperature and print density; high transfer efficiency and the ability to clean any residual toner from the photoconductor, and the absence of filming of the metering blade, development roller and photoconductor over a long print run.

In another aspect of the present invention, there is provided a process for manufacturing an electroreprographic apparatus and/or a component of the apparatus and/or a consumable for use with the apparatus, the process using a toner as described above.

In yet another aspect of the present invention, there is provided an electroreprographic apparatus, a component of the apparatus and/or a consumable for use with the apparatus, which comprises a toner as described above.

All weights referred to herein are percentages based on the total weight of the toner, unless otherwise stated.

The invention will now be illustrated by the following Examples, which are non-limiting on the invention.

1. Preparation of Latexes 1.1. Synthesis of Latex a-1

A low molecular weight resin was synthesised by emulsion polymerisation. The monomers used were styrene (83.2 wt %), 2-hydroxyethyl methacrylate (3.5 wt %) and acrylic ester monomers (13.3 wt %). Ammonium persulphate (0.5 wt % on monomers) was used as the initiator, and a mixture of thiol chain transfer agents (4.5 wt %) was used as chain transfer agents. The surfactant was Akypo™ (a carboxylated alkyl ethoxylate, i.e. a carboxy-functional surfactant) RLM100 (available from Kao, 3.0 wt % on monomers). The emulsion had a particle size of 93 nm, and a Tg midpoint (as measured by differential scanning calorimetry (dsc)) of 55° C. GPC analysis against polystyrene standards showed the resin to have Mn=6,500, Mw=14,000, Mw/Mn=2.2. The solids content was 30 wt %.

1.2. Synthesis of Latex a-2

A latex was made in a similar manner to Latex a-1, except the level of styrene was 90.4 wt % and the level of acrylic ester monomers was 6.1 wt %. The amount of 2-hydroxyethyl methacrylate (3.5 wt %) remained the same. The emulsion had a particle size of 88 nm, and a Tg midpoint (as measured by differential scanning calorimetery (dsc)) of 65° C. GPC analysis against polystyrene standards showed the resin to have Mn=5,100, Mw=12,800, Mw/Mn=2.5. The solids content was 30 wt %.

1.3. Synthesis of Latex a-3

A latex was made in a similar manner to Latex a-1, except the level of styrene was 90.4 wt % and the level of acrylic ester monomers was 6.1 wt %. The amount of 2-hydroxyethyl methacrylate (3.5 wt %) remained the same. The emulsion had a particle size of 91 nm, and a Tg midpoint (as measured by differential scanning calorimetry (dsc)) of 65° C. GPC analysis against polystyrene standards showed the resin to have Mn=5,100, Mw=13,000, Mw/Mn=2.6. The solids content was 30 wt %.

1.4. Synthesis of Latex b-1

A bimodal molecular weight distribution latex was made by a two-stage polymerisation process, in which the higher molecular weight portion was made in the absence of chain transfer agent, and in which the molecular weight of the lower molecular weight portion was reduced by use of 2.5 wt % of mixed thiol chain transfer agents. Ammonium persulphate (0.5 wt % on monomers) was used as the initiator, and the surfactant was Akypo™ RLM100 (available from Kao, 3 wt % on monomers).

The monomer composition for the low molecular weight portion was styrene (82.5%, 2-hydroxyethyl methacrylate (2.5%) and acrylic ester monomers (15.0%). The overall monomer composition was styrene (73.85 wt %), 2-hydroxyethyl methacrylate (6.25 wt %) and acrylic ester monomers (19.9 wt %). The emulsion had a particle size of 78 nm and a Tg midpoint (as measured by dsc) of 67° C. GPC analysis against polystyrene standards showed a bimodal molecular weight distribution with Mn=30,000, Mw=249,000, Mw/Mn=8.3. The solids content was 40 wt %.

1.5. Synthesis of Latex b-2

A latex was made in a similar manner to Latex b-1. The emulsion had a particle size of 79 nm, and a Tg midpoint (as measured by differential scanning calorimetry (dsc)) of 66° C. GPC analysis against polystyrene standards showed the resin to have Mn=31,000, Mw=252,000, Mw/Mn=8.1. The solids content was 40 wt %.

2. Pigment Dispersion

A dispersion of Pigment Red 122 (Hostaperm™ Pink E, Clariant) was used. The pigment was milled in water using a bead mill, with Akypo™ RLM100 (Kao) and Solsperse™ 27000 (Avecia) (a polymeric dispersant) as dispersants. The pigment content of the dispersion was 22.1 wt %.

3. Wax Dispersion

An aqueous wax dispersion was used which contained an 80:20 mixture of Paraflint™ C80 (Fischer-Tropsch wax from Sasol) and Carnauba wax. Akypo™ RLM 100 was used as the dispersant. The mean volume particle size of the wax was approximately 0.4 μm, and the solids content 25 wt %. Analysis by differential scanning calorimetry (dsc) of the dried dispersion showed the wax to have a melting point (peak position from the dsc trace) of approximately 76° C.

4. Toner Preparation 4.1 Toner 1

Latex a-1 (7150 g), Latex b-1 (825 g) the wax dispersion (1429 g ), the pigment dispersion (475 g, containing 105 g Pigment Red 122) and a paste of Bontron E88 (308 g, Orient, containing 60 g of Bontron E88) and water (19830 g) were mixed and stirred. The temperature was raised to 40° C. The mixed dispersions were circulated for 10 mins through a high shear mixer and back into the vessel. Then, as the material was circulating a solution of sulphuric acid was added into the high shear mixer to reduce the pH to 2.5. The temperature was then raised to 55° C., and stirring continued for 1 hr. A solution of sodium dodecybenzene-sulphonate (750 g of a 10% solution) was added, and dilute sodium hydroxide solution was added to raise the pH to 7.3. The temperature was then raised to 120° C. and stirring continued for a further 80 mins. Coulter Counter™ analysis showed the mean volume particle size was 8.7 μm and the final GSD was 1.25. Microscopic analysis showed the toner particles to be of uniform size and of smooth, off-spherical shape. Analysis with a Flow Particle Image Analyser (Sysmex FPIA,) showed the mean circularity to be 0.95

The resultant magenta toner dispersion was filtered on a pressure filter, and washed with water. The toner was then dried in an oven. Analysis by GPC against polystyrene standards, showed the toner resin to have Mn=3,500, Mw=50,600, Mw/Mn=14.4.

Analysis by transmission electron microscopy (TEM) showed the presence of wax domains in the toner, the domain size being approximately 1.0-1.5 μm. BET surface area measurements showed the particles to have a surface area of 0.85 $m^2/g$.

A portion of the toner was blended using a Prism blender with 0.5 wt % of Aerosil™ R812S (Degussa) hydrophobic silica. Analysis by SEM and image analysis showed the mean SF1 value to be 133, and the 50% value (from the cumulative distribution curve) to be 129. The toner was then printed in a monocomponent monochrome printer which had been modified to remove the fuser, to allow printing of un-fused images. Unfused print samples were prepared at 1.0 and 2.0 $mg/cm^2$ using multiple passes through the printer.

The images were then fused off-line using a QEA Fuser-Fixer equipped with a pair of heated oil-less fuser rollers. The fuser speed was set to 20 ppm for images printed on paper, and 10 ppm for images printed on transparencies for an overhead projector. For the prints on both paper and transparency, no hot offset or paper wrapping was found to occur up to 175° C. (the maximum fusion temperature studied)

The samples printed and fused on acetates were examined using a Minolta CM-3600d Haze Meter, according to ASTM D 1003. The results are shown in Table 1:

TABLE 1

| | Haze % (H) | |
|---|---|---|
| Fusion temperature (° C.) | 1 $mg/cm^2$ print density | 2 $mg/cm^2$ print density |
| 130 | 29.3 | 42.5 |
| 135 | 25.6 | 42.9 |
| 140 | 27.1 | 40.8 |
| 145 | 26.8 | 42.0 |
| 150 | 26.2 | 40.4 |
| 155 | 25.1 | 38.8 |
| 160 | 25.5 | 39.5 |

TABLE 1-continued

| | Haze % (H) | |
|---|---|---|
| Fusion temperature (° C.) | 1 $mg/cm^2$ print density | 2 $mg/cm^2$ print density |
| 165 | 24.4 | 40.8 |
| 170 | 23.4 | 40.3 |
| 175 | 23.2 | 40.0 |
| Haze ratio $H_{(130)}/H_{(160)}$ | 1.15 | 1.08 |

As can be seen the samples show minimal variation in haze with fusion temperature in the range studied.

A separate sample of the toner was then printed in a similar printer, but this time with the fuser unit installed. A print run of 1000 text prints was carried out, and the masses of both the consumed toner, and the toner sent to the waste tray were measured. From this a usage efficiency figure, defined as

[1-{(mass of toner sent to the waste tray)/(mass of toner consumed)}]×100 was calculated. The value was 93%.

After a 3000 page print test there was found no noticeable background development on the photoconductor, and no photoconductor filming.

4.2. Toners 2-7

Further Toners 2-7 were made by a similar process to that described for Toner 1, except that the step of adding sodium dodecylbenzenesulphonate prior to the coalescence step was omitted. The latexes used for each toner are shown in Table 2. The toners contained 3.5 wt % Pigment Red 122, and 2 wt % E88 CCA. The toner shape was controlled in each case by the length of the coalescence process (heating above the latex Tg). The average toner particle size (Coulter Counter™, aperture 100 μm), mean circularity (FPIA measurement) and BET surface area of the base toner (i.e. before blending with surface additive) were measured.

Each base toner was then blended with silica as surface additive to produce formulated toner. Two different silica formulations (Type I and II) were used so that each base toner produced two formulated toners:

Type I: a low particle size hydrophobised silica (BET surface area 220 m2/g)

Type II: a mixture of a low particle size hydrophobised silica (BET surface area 220 $m^2/g$) and a larger particle size hydrophobised silica (BET surface area approximately 50 $m^2/g$).

The SF1 and SF2 values were then measured on Type I formulated toner.

The properties of the toners 2-7 are shown in Table 2.

TABLE 2

| Toner | Latexes | Average particle size, $D_v50$ (μm) | Mean circularity of base toner from FPIA | SF1 of formulated toner* | SF2 of formulated toner* | BET surface area of base toner ($m^2/g$) |
|---|---|---|---|---|---|---|
| 2 | a-2 b-2 | 8.1 | 0.91 | 152 | 150 | 1.5 |
| 3 | a-2 b-2 | 7.9 | 0.95 | 142 | 128 | 0.9 |
| 4 | a-3 b-2 | 8.2 | 0.96 | 111 | 118 | 0.7 |
| 5 | a-2 b-2 | 6.8 | 0.91 | 152 | 150 | 1.9 |
| 6 | a-2 b-2 | 6.8 | 0.94 | 139 | 128 | 0.9 |
| 7 | a-3 b-2 | 6.8 | 0.98 | 116 | 117 | 0.9 |

*measured on toners with Type I surface additive formulation

Transfer efficiency (TE) data was then recorded for transfer from the organic photoconductor (OPC) of a monocomponent monochrome printer to a transparency substrate by measuring the mass of toner on the OPC and on the substrate by vacuuming the toner into a filter which was weighed. Masses on the OPC were determined by crash-stopping the printer. Masses on the substrate were determined by stopping the print before the fuser. The control parameters of the printer were altered to develop different print densities, and the data in Table 3 below shows TE values for each toner recorded across a range of print densities.

TABLE 3

| Toner | Surface Additive Type | Transfer Efficiency (%) OPC to substrate |
|---|---|---|
| 2 | I | 94-96 |
| 2 | II | 87-94 |
| 3 | I | 99-100 |
| 3 | II | 95-97 |
| 5 | I | 94 |
| 5 | II | 93-99 |
| 6 | I | 97-100 |
| 6 | II | ~100 |

It can be seen that the non-spherical toners having the best transfer efficiency are toners 3 and 6. In some cases the transfer efficiency is up to 100%. Toners 2 and 5 also have good but generally lower transfer efficiency. The non-spherical toners also clean well from a photoconductor using a mechanical cleaning device. Toners 4 and 7 (results not shown) are the most spherical shape and these toners transfer from a photoconductor to a substrate well but efficiency of cleaning from a photoconductor with a mechanical cleaning device is lower than for the non-spherical toners.

Throughout the description and claims of this specification, the words "comprise" and "contain" and variations of the words, for example "comprising" and "comprises", mean "including but not limited to", and are not intended to (and do not) exclude other components.

Unless the context clearly indicates otherwise, plural forms of the terms herein are to be construed as including the singular form and vice versa.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

It will be appreciated that many of the features described above, particularly of the preferred embodiments, are inventive in their own right and not just as part of an embodiment of the present invention. Independent protection may be sought for these features in addition to or alternative to any invention presently claimed.

The invention claimed is:

1. A toner for developing an electrostatic image comprising toner particles which include a binder resin, a wax and a colorant, wherein the wax has a melting point of between 50 and 150° C., and the wax exists in the toner particles in domains of 2 μm or less mean particle size and wherein (a) the mean circularity of the toner particles as measured by a Flow Particle Image Analyser is at least 0.90; and (b) the shape factor, SF1, of the toner particles is in the range from 130 to 150; and wherein the binder resin is prepared from at least one latex containing a resin having a monomodal molecular weight distribution and at least one latex containing a resin having a bimodal molecular weight distribution, and (c) the ratio SF1/SF2 of the shape factor, SF1, to the shape factor, SF2, is from 1.07 to 1.13.

2. A toner according to claim 1 wherein the mean circularity of the toner particles is in the range from 0.93 to 0.99.

3. A toner according to claim 2 wherein the mean circularity of the toner particles is in the range from 0.94 to 0.96.

4. A toner according to claim 2 wherein SF2 of the toner particles is in the range from 125 to 135.

5. A toner according to claim 1 wherein SF1 of the toner particles is at most 145.

6. A toner according to claim 5 wherein SF1 of the toner particles is in the range from 135 to 145.

7. A toner according to claim 1 wherein SF2 of the toner particles is in the range from 120 to 140.

8. A toner according to claim 1 wherein the BET surface area of the particles is 0.7-1.1 $m^2/g$.

9. A toner according to claim 1 wherein the wax exists in the toner in domains of mean diameter 1.5 μm or less.

10. A toner according to claim 1 wherein the monomodal molecular weight resin is a low molecular weight resin and has a number average molecular weight of from 3000 to 10000.

11. A toner according to claim 1 wherein the bimodal resin has a weight average molecular weight of from 100,000 to 500,000.

12. A toner according to claim 1 wherein the resin comprises a copolymer of (i) a styrene or substituted styrene, (ii) at least one alkyl acrylate or methacrylate and (iii) an hydroxy-functional acrylate or methacrylate.

13. A toner according to claim 1 wherein the amount of wax is from 3 to 20 wt %.

14. A toner according to claim 1 which further comprises a charge control agent.

15. A process for forming an image, the process comprising developing an electrostatic image using a toner according to claim 1, wherein the haze at a print density of 1.0 $mg/cm^2$ is below 40, and the ratio of the values at fusion temperatures of 130 and 160° C. is at most 1.5.

16. A toner for developing an electrostatic image comprising toner particles which include a binder resin, a wax and a colorant, wherein the wax has a melting point of between 50 and 150° C., and the wax exists in the toner particles in domains of 2 μm or less mean particle size and wherein (a) the mean circularity of the toner particles as measured by a Flow Particle Image Analyser is in the range from 0.94 to 0.96;

(b) the shape factor, SF1, of the toner particles is in the range from 135 to 145; and wherein the binder resin is prepared from at least one latex containing a resin having a monomodal molecular weight distribution and at least one latex containing a resin having a bimodal molecular weight distribution, and (c) SF1>SF2.

17. A process for the manufacture of a toner for developing an electrostatic image comprising toner particles which include a binder resin, a wax and a colorant, wherein the wax has a melting point of between 50 to 150° C.; and the wax exists in the toner particles in domains of 2 μm or less mean particle size and wherein (a) the mean circularity of the toner particles as measured by a Flow Particle Image Analyser is at least 0.90; and (b) the shape factor, SF1, of the toner particles is at most 165, which process comprises the following steps:

I. providing a latex dispersion which has at least one latex with a monomodal molecular weight distribution and has at least one latex with a bimodal molecular weight distribution;

II. providing a wax dispersion;

III. providing a colorant dispersion;

IV. mixing the latex dispersion, wax dispersion and colorant dispersion; and

V. causing the mixture to flocculate to produce said toner.

18. A process according to claim 17 wherein the monomodal molecular weight latex has a number average molecular weight of from 3000 to 10000.

19. A process according to claim 18 wherein the monomodal molecular weight latex has a number average molecular weight of from 3000 to 6000.

20. A process according to claim 17 wherein the bimodal latex has a weight average molecular weight of from 100,000 to 500,000.

21. A toner according to claim 20 wherein the bimodal latex has a weight average molecular weight of from 200,000 to 400,000.

22. A process according to claim 17 further comprising heating the flocculated mixture obtained after step (v) to form loose aggregates of particle size from 3 to 20 μm.

23. A process according to claim 22 further comprising heating the aggregates to a temperature above the $T_g$ of the latex to induce coalescence to form toner particles.

24. A process according to claim 17 wherein the latex dispersion comprises an ionic surfactant.

25. A process according to claim 17 wherein the latex containing a resin having a bimodal molecular weight distribution is prepared by a process comprising the successive steps of forming a polymer of high molecular weight distribution followed by forming a polymer of low molecular weight distribution such that the resulting latex comprises composite particles comprising both said low molecular weight polymer and said high molecular weight polymer.

26. A process according to claim 17 which, prior to step iv, further comprises the step of providing a charge control agent dispersion, which dispersion is then incorporated in step iv by mixing.

27. A process according to claim 26 wherein the charge control agent is milled with the colorant.

28. A process according to claim 17 wherein the preparation of the wax dispersion comprises the mixing together of the wax with an ionic surfactant.

29. A process according to claim 17 wherein the preparation of the colorant dispersion comprises the milling together of the colorant with an ionic surfactant.

30. A process according to claim 17 wherein the dispersions of latex, colorant, wax, and charge control agent where present, have the same sign charge on the surfactant.

31. A process according to claim 30 wherein the surfactant present in the dispersions contains a group which can be converted from an ionic to a non-ionic form and vice versa by adjustment of pH.

32. A toner for developing an electrostatic image which has been obtained by the process of claim 17.

* * * * *